US009884700B2

(12) United States Patent
Kao

(10) Patent No.: US 9,884,700 B2
(45) Date of Patent: Feb. 6, 2018

(54) DUAL-USE LID AND CONTAINING ASSEMBLY COMPRISING THE SAME

(71) Applicant: HIGHPLUS INTERNATIONAL CO., LTD., New Taipei (TW)

(72) Inventor: Chih-Hung Kao, New Taipei (TW)

(73) Assignee: Highplus International Co., Ltd., New Taipei (TW)

( * ) Notice: Subject to any disclaimer, the term of this patent is extended or adjusted under 35 U.S.C. 154(b) by 244 days.

(21) Appl. No.: 14/730,290

(22) Filed: Jun. 4, 2015

(65) Prior Publication Data

US 2016/0355298 A1 Dec. 8, 2016

(51) Int. Cl.
*B65D 81/32* (2006.01)
*B65D 8/00* (2006.01)
*B65D 21/02* (2006.01)

(52) U.S. Cl.
CPC ..... *B65D 15/08* (2013.01); *B65D 21/0238* (2013.01); *B65D 81/3205* (2013.01); *B65D 2231/022* (2013.01)

(58) Field of Classification Search
CPC ..... B65D 25/40; B65D 25/42; B65D 47/06; B65D 15/08; B65D 21/0238; B65D 81/3205
USPC ..... 206/217
See application file for complete search history.

(56) References Cited

U.S. PATENT DOCUMENTS 3,288,344 A * 11/1966 Woollen ..... A47G 19/065 206/217
3,323,706 A * 6/1967 Gereke ..... A47G 19/065 206/217
5,180,079 A * 1/1993 Jeng ..... A47G 19/065 206/217
5,573,131 A * 11/1996 Berjis ..... A47G 19/2272 220/4.03
5,695,052 A * 12/1997 Damato ..... A47G 19/065 206/217
5,725,117 A * 3/1998 Berjis ..... A47G 19/2272 220/4.03
5,816,437 A * 10/1998 Lin ..... B65D 15/14 220/611
5,954,195 A * 9/1999 Krueger ..... A47G 19/065 206/217
6,338,417 B1 * 1/2002 Ferraro ..... B65D 21/0228 206/217
6,382,449 B1 * 5/2002 Kazmierski ..... B65D 3/14 220/4.03

(Continued)

FOREIGN PATENT DOCUMENTS

TW 201420445 A 6/2014

*Primary Examiner* — J. Gregory Pickett
*Assistant Examiner* — Ernesto Grano
(74) *Attorney, Agent, or Firm* — Alan D. Kamrath; Kamrath IP Lawfirm, P.A.

(57) ABSTRACT

A dual-use lid includes a cover. The cover has a protruding segment, an annular wall, and a circular body. The protruding segment is formed on the cover. The annular wall extends from the protruding segment. The circular body is formed on the annular wall. The dual-use lid can be combined with various containers. An annulus is detachably mounted on the cover to form a space for loading food, and users are able to have drink and food at the same time. In addition, the cover and annulus are detachable, such that the cover and annulus can be transported and stored in an increased amount.

3 Claims, 16 Drawing Sheets

(56) References Cited

U.S. PATENT DOCUMENTS 6,425,480 B1 * 7/2002 Krueger ..... A47G 19/065 206/217
6,427,864 B1 * 8/2002 Asselin ..... B65D 21/0224 206/217
6,474,494 B1 * 11/2002 Miller ..... A47G 19/065 206/217
6,706,297 B1 * 3/2004 Toth ..... A47G 19/065 206/223
7,111,748 B2 * 9/2006 Cha, II ..... A47G 19/065 220/4.27
7,182,242 B2 * 2/2007 Cai ..... A47G 19/065 206/217
7,217,434 B1 * 5/2007 Loh ..... B65D 81/3205 206/217
7,748,536 B2 * 7/2010 Cassese ..... A47G 19/06 206/542
8,172,103 B2 * 5/2012 Spyros ..... A47G 19/00 206/217
8,186,538 B2 * 5/2012 MacCarthy ..... A47G 19/065 206/217
8,276,749 B1 * 10/2012 Schrauwen ..... A24F 19/0078 206/217
8,485,378 B2 * 7/2013 Zoss ..... A47G 19/02 206/219
8,544,671 B2 * 10/2013 Cerasani ..... B65D 1/34 206/508
8,672,175 B2 * 3/2014 Farmer ..... B65D 1/36 220/737
8,757,404 B1 * 6/2014 Fleckenstein ..... A47J 41/0005 206/217
8,783,506 B2 * 7/2014 Lee ..... B65D 47/305 206/217
8,807,372 B2 * 8/2014 Kao ..... B65D 21/0238 215/319
8,939,312 B1 * 1/2015 Buck ..... A47G 19/065 220/212
D741,025 S * 10/2015 Ross ..... D30/121
D770,100 S * 10/2016 Burroughs ..... D30/121
9,463,913 B2 * 10/2016 Strominger ..... B65D 51/28
2003/0173237 A1 * 9/2003 Kim ..... B65D 3/24 206/217
2009/0065377 A1 * 3/2009 Olomi ..... B65D 41/26 206/217

* cited by examiner

DUAL-USE LID AND CONTAINING ASSEMBLY COMPRISING THE SAME

BACKGROUND OF THE INVENTION

1. Field of the Invention

The present invention relates to a container and, especially, to a containing assembly comprising a dual-use lid that can be combined easily and conveniently with different cups or bottles.

2. Description of the Prior Arts

When buying food and drink, a consumer needs to use two hands to hold the food and the drink separately. The consumer has to put down the drink on a place and to start having the food. The inconvenience of eating and drinking needs improvement.

A conventional container is disclosed in publication No. TW 201420445 with a folding structure and has a cup and a folding body. The cup has a circular wall and a containing groove. The folding body is formed on the cup. The folding body has an annular wall, multiple folding lines, and an engaging portion. The folding lines are formed on the annular wall, and the folding body can be folded along the folding lines. The engaging portion is combined with the circular wall of the cup. The conventional container can be used for having the drink and the food at the same time. The cup is combined with the folding body and is unable to be separated, so the transporting or storage of the conventional container is limited in amount due to the large volume of the cup and the folding body.

To overcome the shortcomings, the present invention provides a dual-use lid and a containing assembly combined with the dual-use lid to mitigate or obviate the aforementioned problems.

SUMMARY OF THE INVENTION

The main objective of the present invention is to provide a dual-use lid and a containing assembly combined with the dual-use lid to improve the convenience of transportation and storage.

The dual-use lid comprises a cover and an annulus. The cover has a protruding segment and an annular board. The protruding segment is formed on the cover. The annular board extends outward from a bottom edge of the protruding segment. The annulus is mounted on the annular board of the cover.

The containing assembly comprises an annulus and a container. The annulus is detachably combined with the circular body of the cover. The annulus has an annular body, at least one first combining portion, and at least one second combining portion. The at least one first combining portion is formed on a side of the annular body. The at least one second combining portion is formed on another side of the annular body and is connected to the at least one first combining portion. The container is detachably mounted in the cover and has a chamber and an upper rim. The chamber is formed in the container. The upper rim is formed around a top edge of the container. The upper rim is mounted in the protruding segment under the cover.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
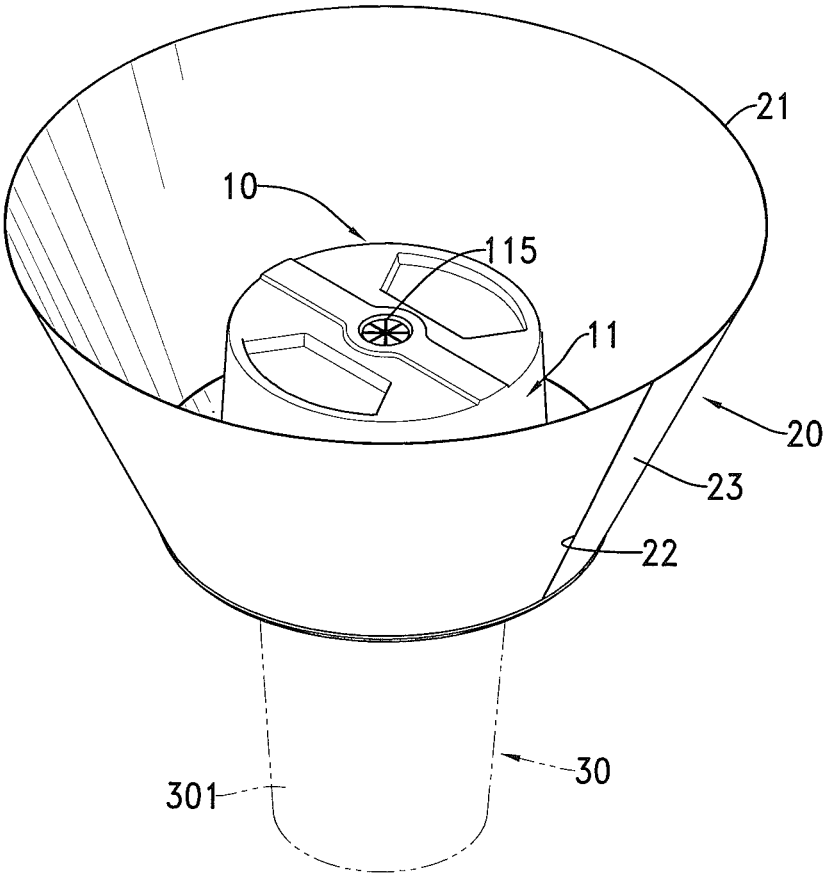
FIG. 1 is a perspective view of a first embodiment of a dual-use lid in accordance with the present invention.
Figure 2:
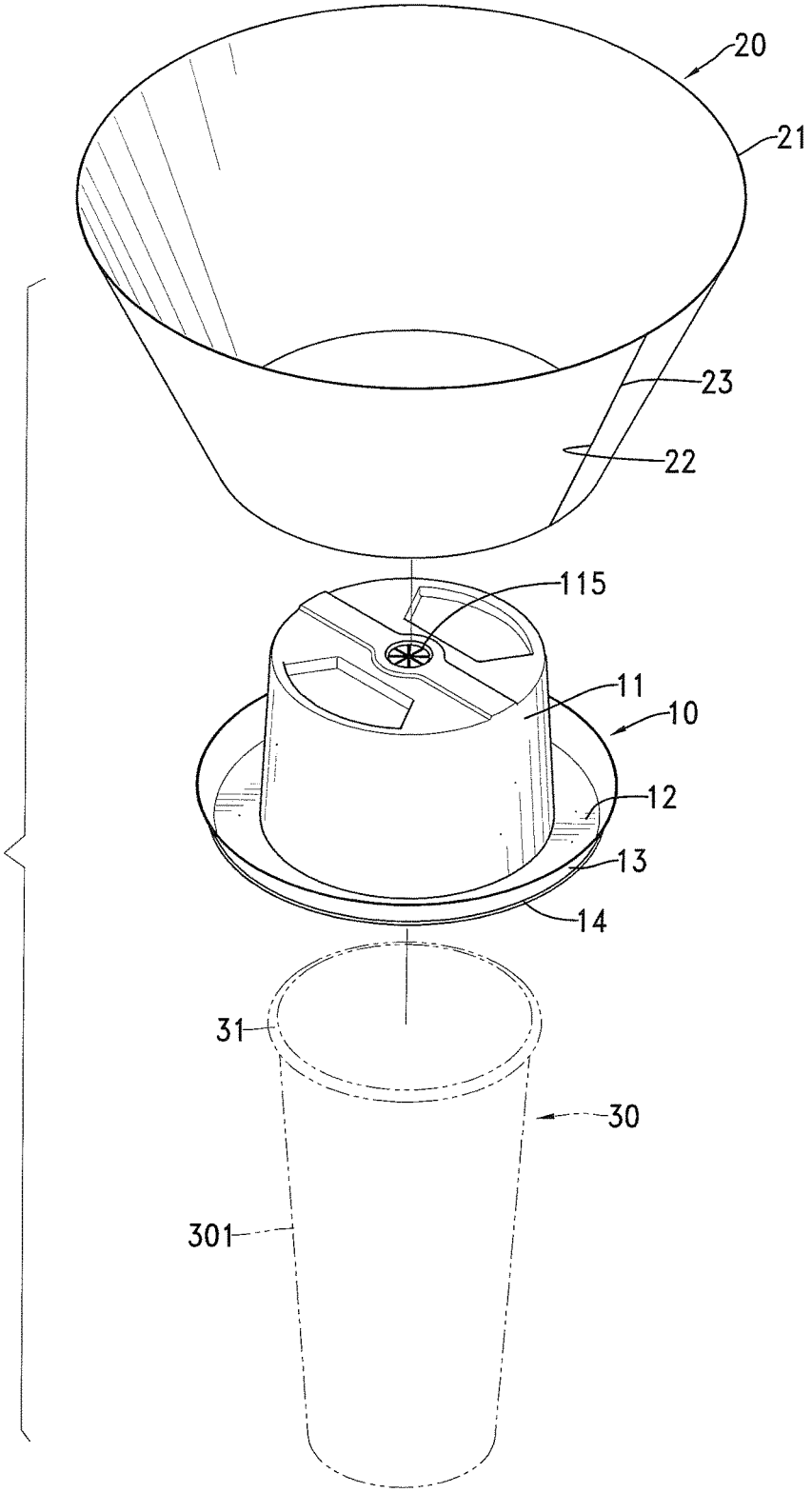
FIG. 2 is an exploded perspective view of the containing assembly in FIG. 1.
Figure 3:
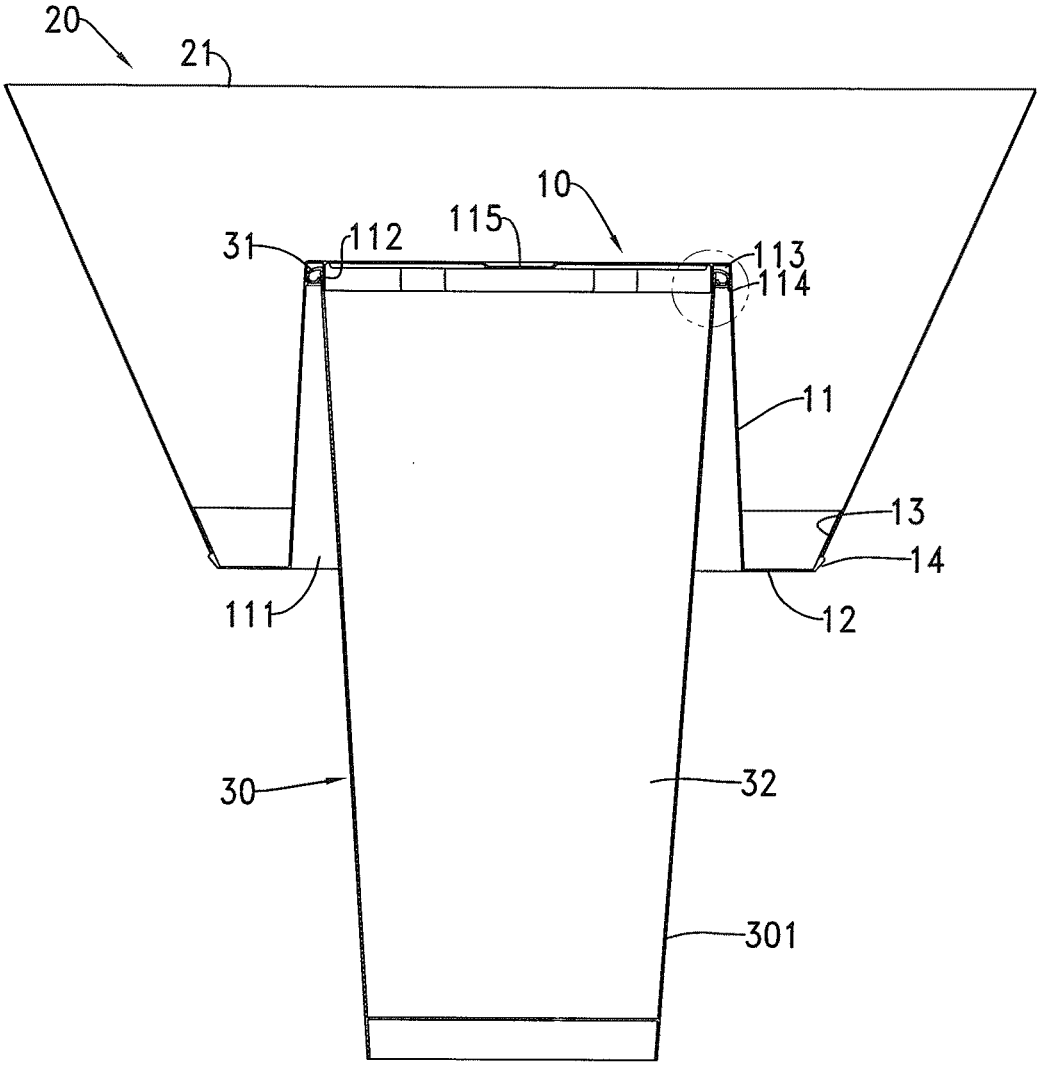
FIG. 3 is a cross-sectional side view of the containing assembly in FIG. 1.

With reference to FIGS. 1 to 3, a first embodiment of a containing assembly combined with a dual-use lid in accordance with the present invention comprises a cover 10. In addition, an annulus 20 and a container 30 are respectively connected to a top side and a bottom side of the cover 10.

Figure 4:
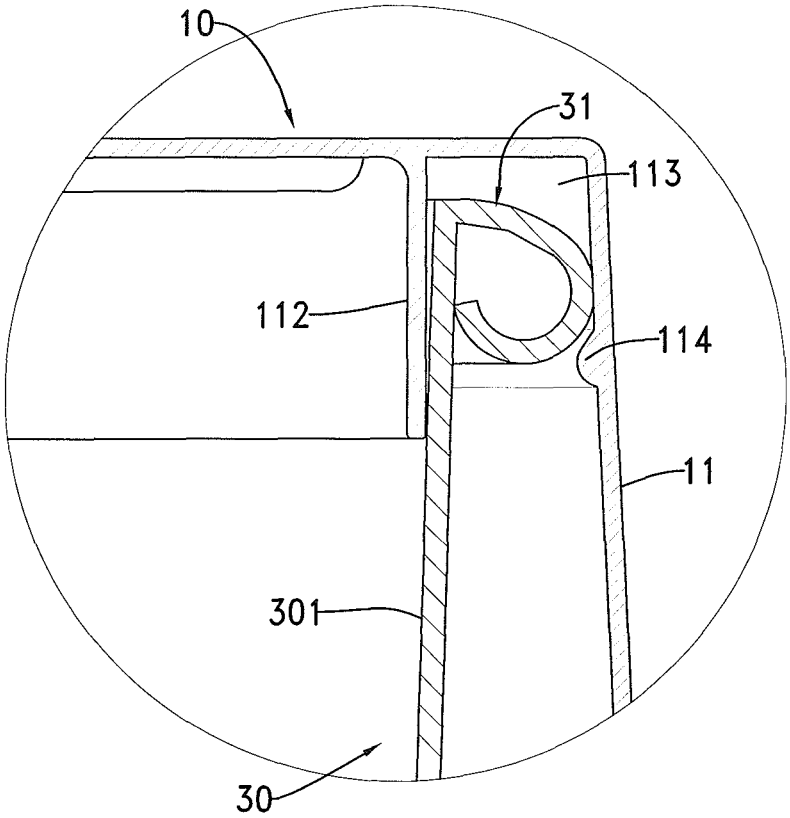
FIG. 4 is a partially enlarged side view of the containing assembly in FIG. 3.

The cover 10 is made of a plastic material and has a protruding segment 11, an annular board 12, an annular wall 13, and a circular body 14. The protruding segment 11 is formed on a top surface of the cover 10. With reference to FIGS. 3 and 4, the protruding segment 11 of the cover 10 has a groove 111, a circular inner wall 112, a first circular groove 113, a first circular fastener 114, and an inserting hole 115. The groove 111 is formed on a bottom side of the protruding segment 11. The circular inner wall 112 extends downward from the protruding segment 11 to the groove 111. The first circular groove 113 is formed between the circular inner wall 112 and an inside wall of the groove 111. The first circular fastener 114 is formed on the inside wall of the groove 111. The inserting hole 115 is formed through the protruding segment 11.

Figure 5:
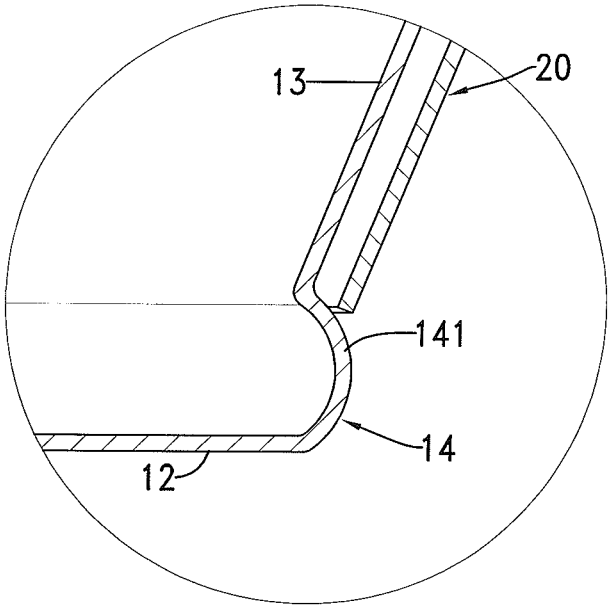
FIG. 5 is a partially enlarged cross-sectional side view of a first embodiment of a circular body of the containing assembly in FIG. 1.

The annular board 12 horizontally extends outward from a bottom edge of the protruding segment 11. The annular wall 13 extends upward from an outer edge of the annular board 12. With reference to FIG. 5, the circular body 14 is formed on a bottom edge of the annular wall 13, and a bottom diameter of the annular wall 13 is smaller than a diameter of the circular body 14.

The annulus 20 is detachably mounted on the annular board 12 of the cover 10. The annulus 20 is a thin sheet and has an annular body 21, at least one first combining portion 22, and at least one second combining portion 23. The annular body 21 is a thin sheet and has two sides. The at least one first combining portion 22 is formed on one of the sides of the annular body 21, and the at least one second combining portion 23 is formed on the other side of the annular body 21. The at least one first combining portion 22 is connected to the at least one second combining portion 23 to form a hollow cone. With reference to FIGS. 3 to 5, in a first embodiment of the circular body 14, the circular body 14 has a circular convex portion 141. The circular convex portion 141 is formed on a top edge of the circular body 14.

The annulus 20 is sleeved around the annular wall 13 and is connected to the cover 10. The annulus 20 is sustained by the circular convex portion 141 to avoid accidental falling. The annulus 20 is made of plastic or paper materials. The annulus 20 is slightly flexible, such that the annulus 20 can be deformed for mounting on the cover 10 by users. The annulus 20 is made of printable materials. Multiple annuluses 20 can be piled when the first combining portions 22 and the second combining portions 23 are unfolded. The storage space for the annuluses 20 could be reduced.

Figure 6:
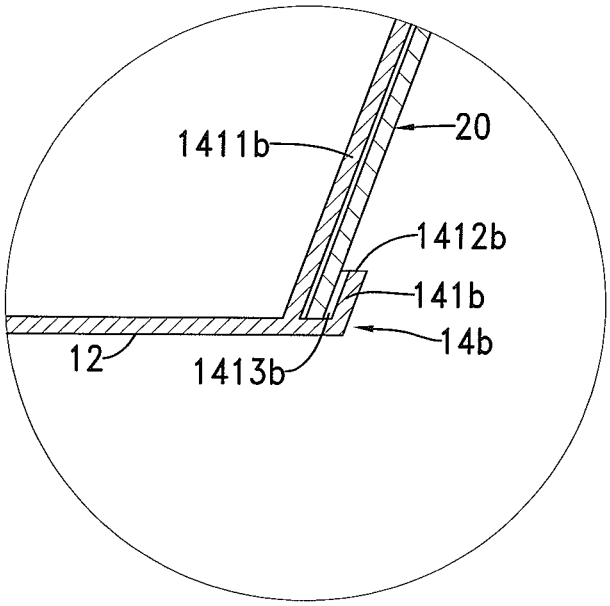
FIG. 6 is a partially enlarged cross-sectional side view of a second embodiment of the circular body of the containing assembly in FIG. 1.

With reference to FIG. 6, in a second embodiment of the circular body 14*b* in accordance with the present invention, the circular body 14*b* has a circular portion 141*b*. The circular portion 141*b* is L-shaped in cross section. The circular portion 141*b* has an inner circular sheet 1411*b*, an outer circular sheet 1412*b*, and a circular slot 1413*b*. The inner circular sheet 1411*b* is formed on an inner side of the circular portion141*b*, and the outer circular sheet 1412*b* is formed on an outer side of the circular portion 141*b*. A height of the inner circular sheet 1411*b* is larger than a height of the outer circular sheet 1412*b*. The circular slot 1413*b* is formed between the inner circular sheet 1411*b* and the outer circular sheet 1412*b*. A width of the circular slot 1413*b* is conformed to a width of the annulus 20. The annulus 20 is sleeved around the inner circular sheet 1411*b* and is mounted in the circular slot 1413*b*.

Figure 7:
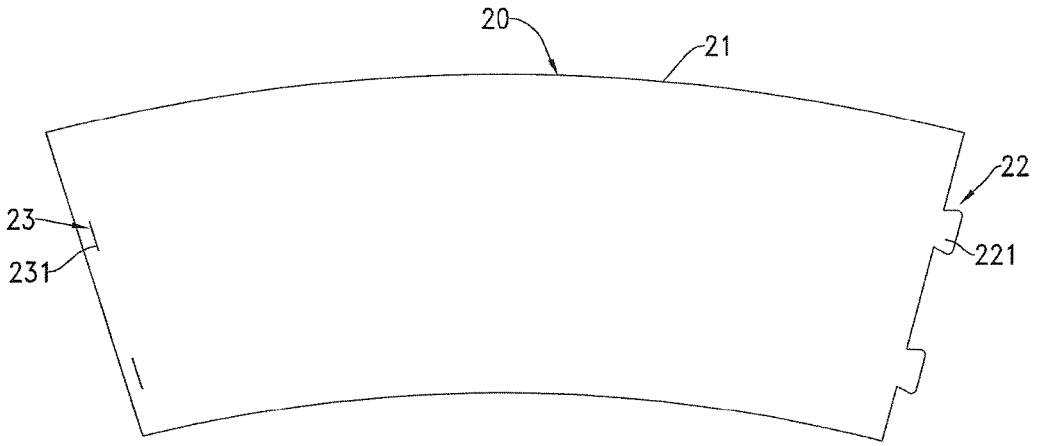
FIG. 7 is a front side view of a first embodiment of an annulus of the containing assembly in FIG. 1.

With reference to FIG. 7, in the first embodiment of the annulus 20, each first combining portion 22 of the annulus 20 is an engaging member 221,and each second combining portion 23 is an engaging hole 231. Each engaging member 221 is respectively connected to a corresponding engaging hole 231 to form the annulus 20.

Figure 8:
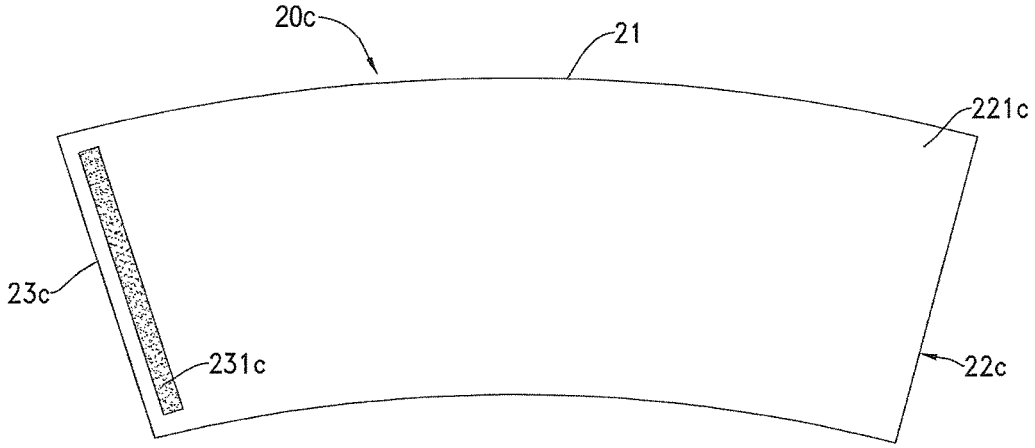
FIG. 8 is a front side view of a second embodiment of the annulus of the containing assembly in FIG. 1.

With reference to FIG. 8, in a second embodiment of the annulus 20*c*, each first combining portion 22*c* of the annulus 20*c* is a laminating surface 221*c*, and each second combining portion 23*c* is an adhesive surface 231*c*. Double sided adhesive tapes or adhesive materials can be coated on each adhesive surface 231*c*, so each adhesive surface 231*c* is attached to a corresponding laminating surface 221*c* to form the annulus 20*c*.

With reference to FIGS. 2 and 3, the container 30 is detachably connected to the cover 10 with the annulus 20 to form a containing assembly. The container 30 has a chamber 32 and an upper rim 31. The chamber 32 is formed in the container 30. The upper rim 31 is formed around a top edge of the container 30. The upper rim 31 is mounted in the protruding segment 11 under the cover 10. An external surface of the container 30 is made of printable materials. Users can hold the container 30 by one hand, and the food is put between the cover 10 and the annulus 20. Preferably, the container 30 can be a paper cup 301, a plastic cup 302, an aluminum can 303, or a PET bottle 304.

With reference to FIG. 4, the container 30 is connected with the cover 10. The first circular groove 113 is used to hold the container 30. When the cover 10 is mounted on the container 30, the upper rim 31 of the container 30 is mounted in the first circular groove 113, and the upper rim 31 is positioned by the first circular fastener 114. Then, the groove 111 of the protruding segment 11 is disposed around an upper part of the container 30.

Figure 9:
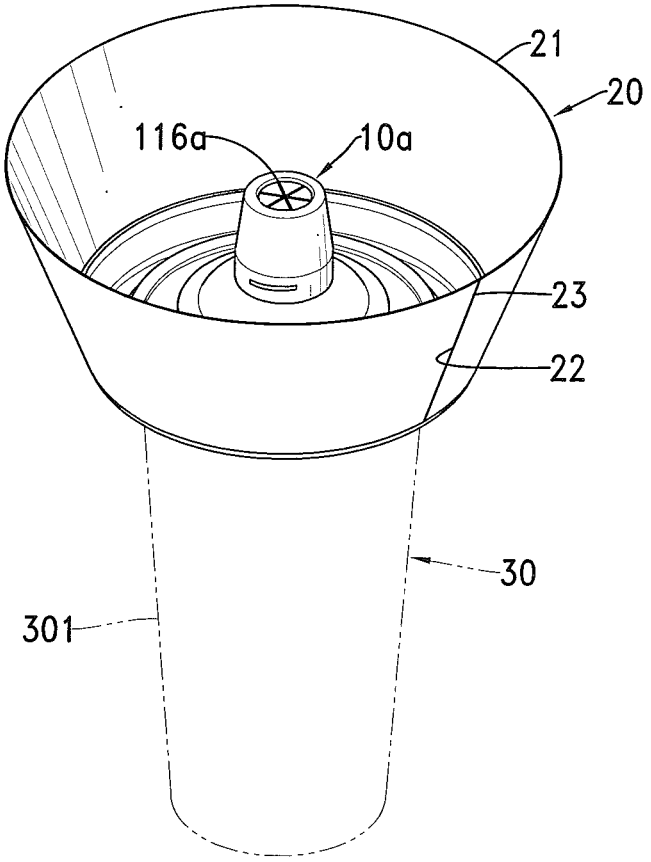
FIG. 9 is a perspective view of the second embodiment of a dual-use lid in accordance with the present invention.
Figure 10:
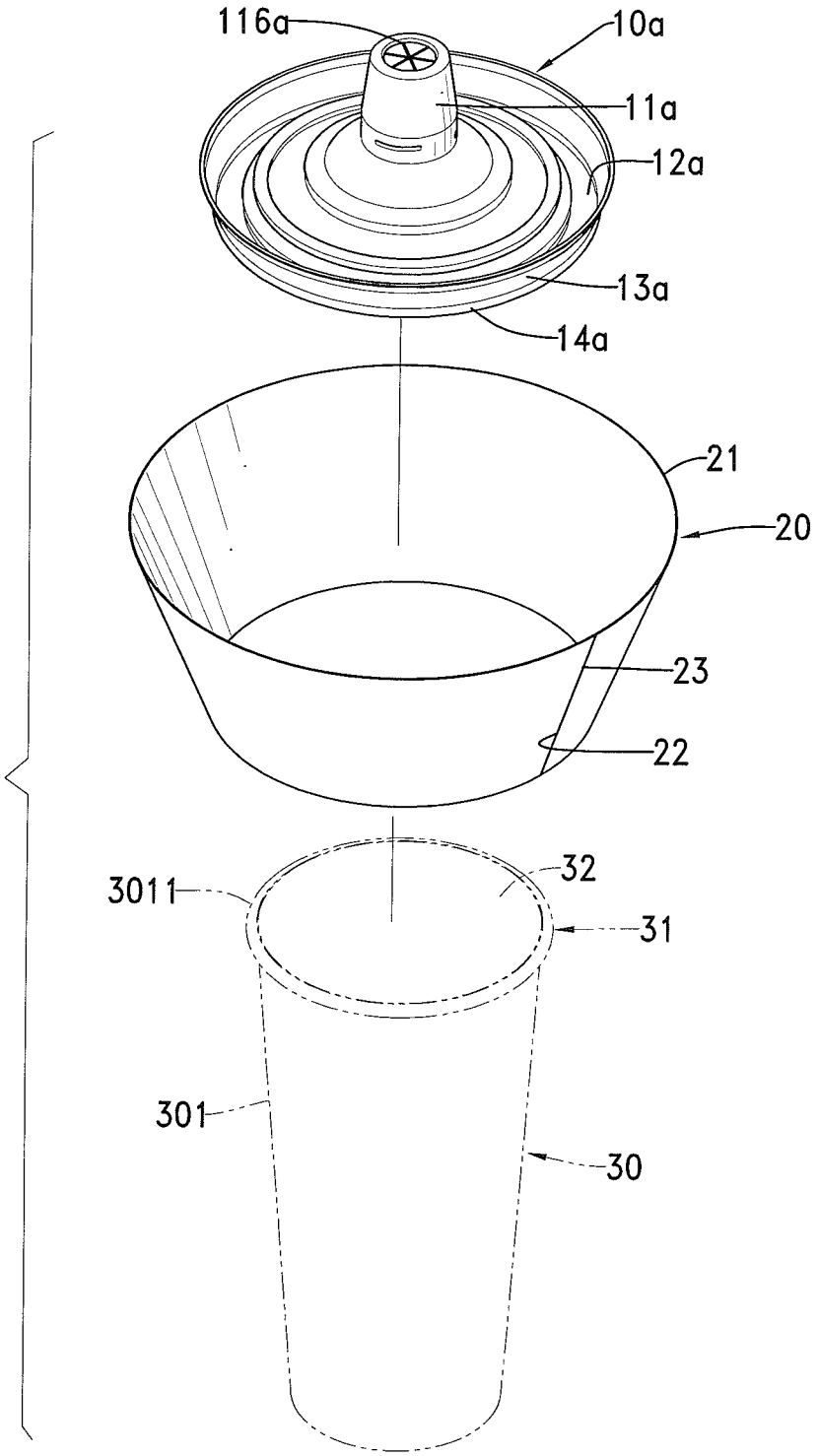
FIG. 10 is an exploded perspective view of the containing assembly in FIG. 9.
Figure 11:
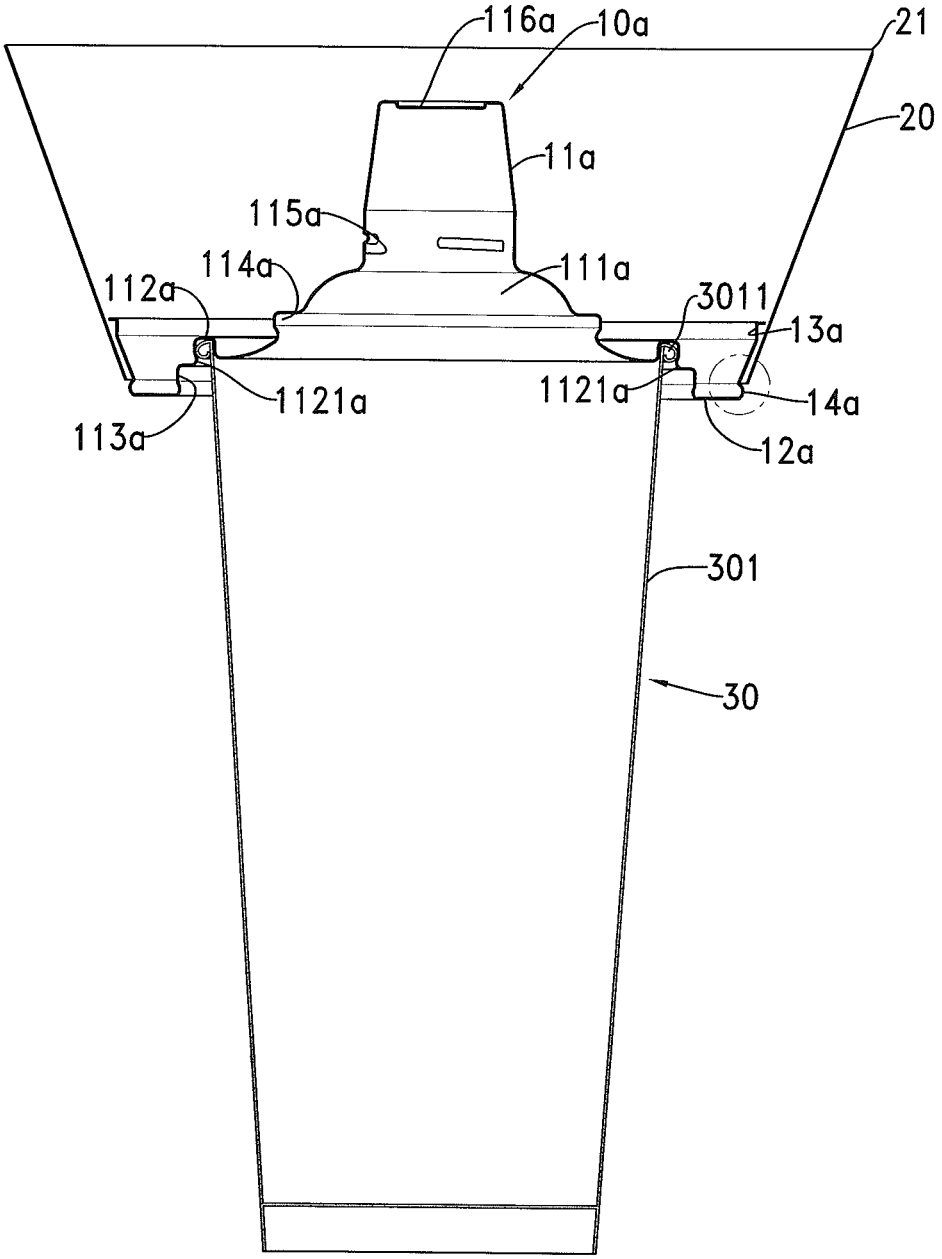
FIG. 11 is a cross-sectional side view of the container combined with a paper cup in FIG. 9.
Figure 12:
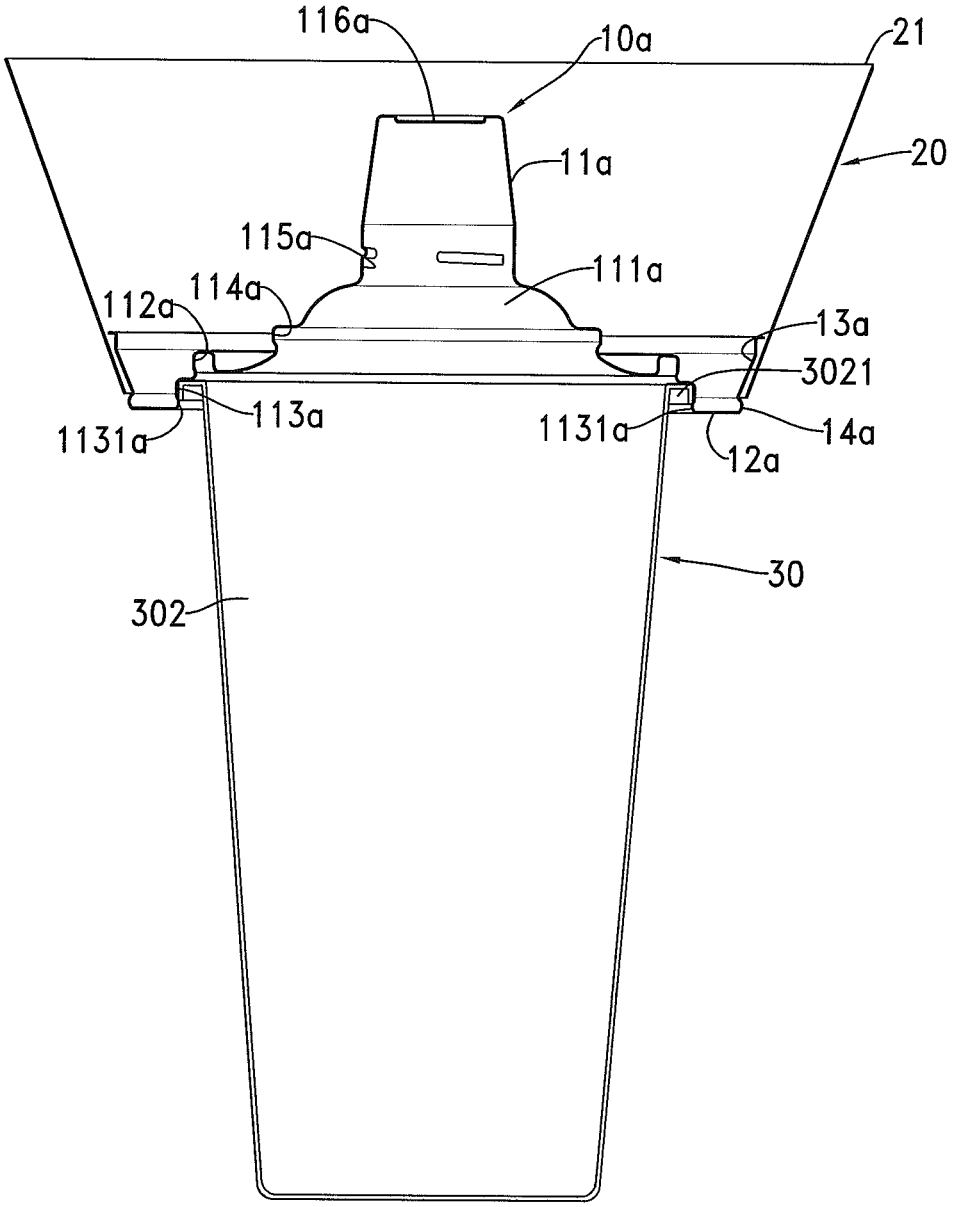
FIG. 12 is a cross-sectional side view of the container combined with a plastic cup in FIG. 11.

With reference to FIGS. 9 to 11, a second embodiment of a dual-use lid in accordance with the present invention is combined with a paper cup 301 and comprises a cover 10*a*. The cover 10*a* has a protruding segment 11 a, an annular board 12*a*, an annular wall 13*a*, and a circular body 14*a*. The protruding segment 11 a is formed on a top surface of the cover 10*a* and has a groove 111*a*, a first circular groove 112*a*, a second circular groove 113*a*, a third circular groove 114*a*, a combining groove 115*a*, and an inserting opening 116*a*. The groove 111*a* is formed on a bottom side of the protruding segment 11*a*. The first circular groove 112*a* is formed on an inner surface of the protruding segment 11*a* and has a first ring 1121*a*. The first ring 1121*a* is formed on a bottom edge of the first circular groove 112*a*. The paper cup 301 has a paper upper rim 3011. The paper upper rim 3011 is mounted in the first circular groove 112*a* and is fastened with the first ring 1121*a*. With reference to FIG. 12, the dual-use lid is combined with a plastic cup 302. The second circular groove 113*a* is formed on the inner surface of the protruding segment 11*a* under the first circular groove 112*a* and has a second ring 1131*a*. The second ring 1131*a* is formed on a bottom edge of the second circular groove 113*a*. The plastic cup 302 has a plastic upper rim 3021. The plastic upper rim 3021 is mounted in the second circular groove 113*a* and is fastened with the second ring 1131*a*. In addition, a diameter of the second circular groove 113*a* is greater than a diameter of the first circular groove 112*a*.

Figure 13:
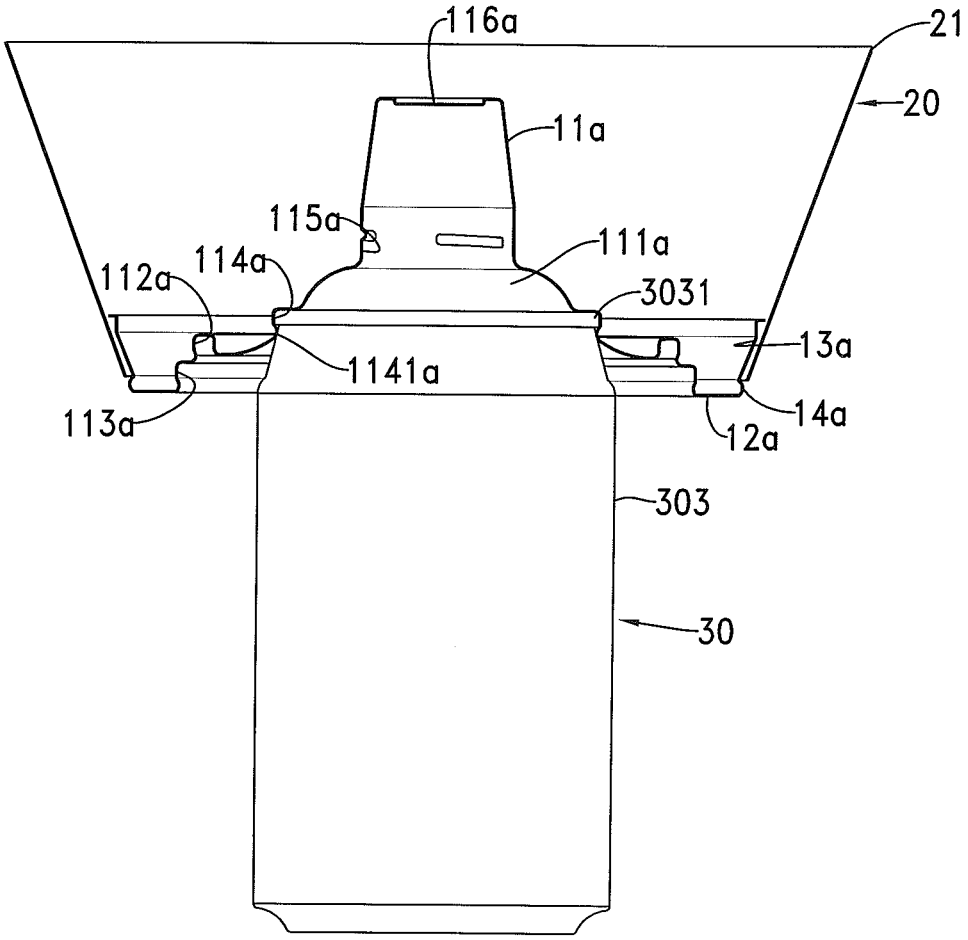
FIG. 13 is a cross-sectional side view of the container combined with an aluminum can in FIG. 11.

With reference to FIG. 13, the dual-use lid is combined with an aluminum can 303. The third circular groove 114*a* is formed on an inner surface of the protruding segment 11*a* over the first circular groove 112*a*. The third circular groove 114*a* has a third ring 1141 a formed on a bottom edge of the third circular groove 113*a*. The aluminum can 303 has an aluminum upper rim 3031. The aluminum upper rim 3031 is mounted in the third circular groove 114*a* and is fastened with the third ring 1141*a*. In addition, a diameter of the third circular groove 114*a* is smaller than the diameter of the first circular groove 112*a*.

Figure 14:
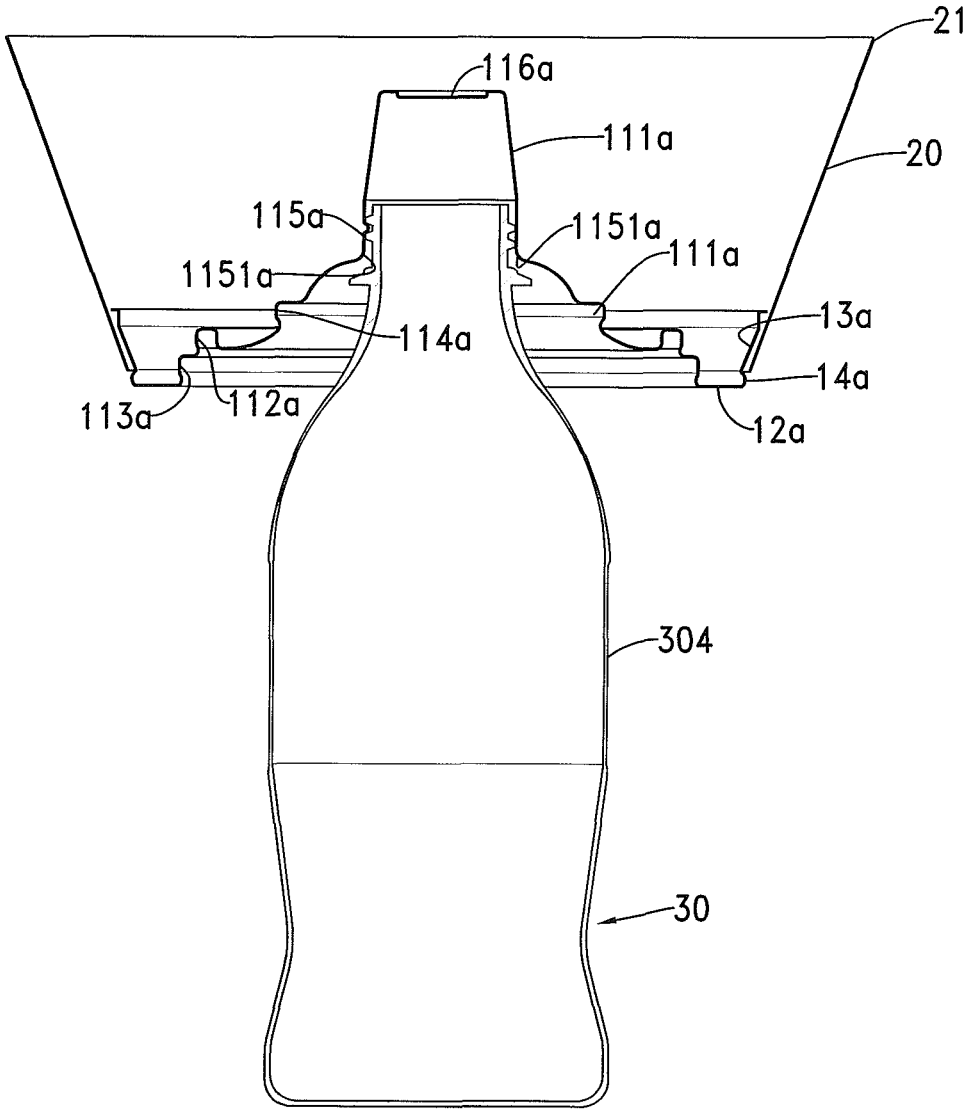
FIG. 14 is a cross-sectional side view of the container combined with a PET bottle in FIG. 11.

With reference to FIG. 14, the dual-use lid is combined with a PET bottle 304. The combining groove 115*a* is formed on the inner surface of the protruding segment 11*a* over the third circular groove 114*a*. The combining groove 115*a* has a fourth ring 1151*a* formed on a bottom edge of the combining groove 115*a*. The PET bottle 304 has a bottle opening. The bottle opening of the PET bottle 304 is disposed in the combining groove 115*a* and is fastened with the fourth ring 1151*a*. In addition, a diameter of the combining groove 115*a* is smaller than the diameter of the third circular groove 114*a*. The inserting opening 116*a* is formed through the protruding segment 11*a*. The annular board 12*a* horizontally extends outward from a bottom edge of the protruding segment 11*a*. The annular wall 13*a* extends upward from the outer edge of the annular board 12*a*. The circular body 14*a* is formed on the bottom edge of the annular wall 13*a*.

Figure 15:
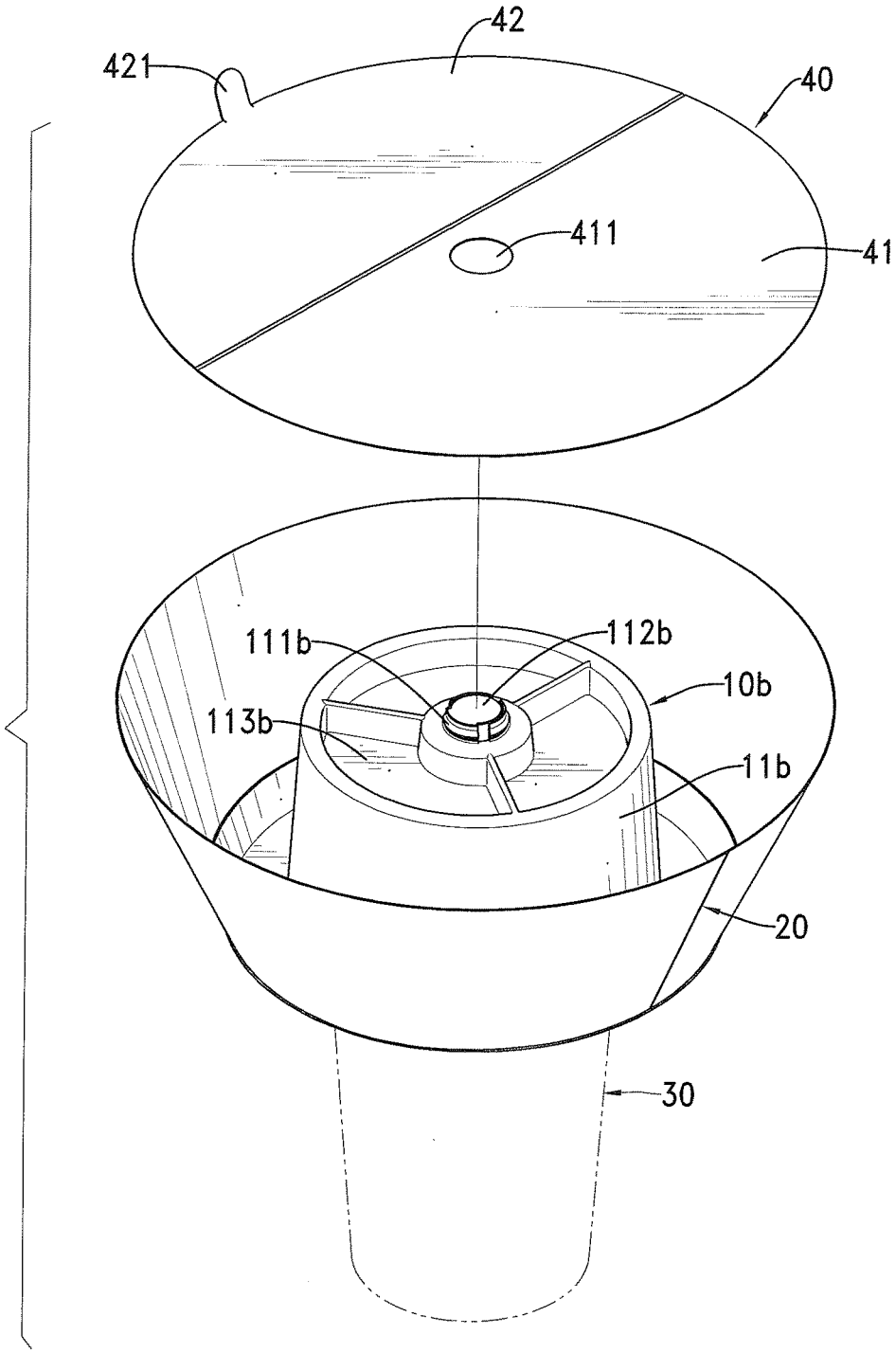
FIG. 15 is an exploded perspective view of a third embodiment of a dual-use lid in accordance with the present invention connected to a cover and a lifting board.
Figure 16:
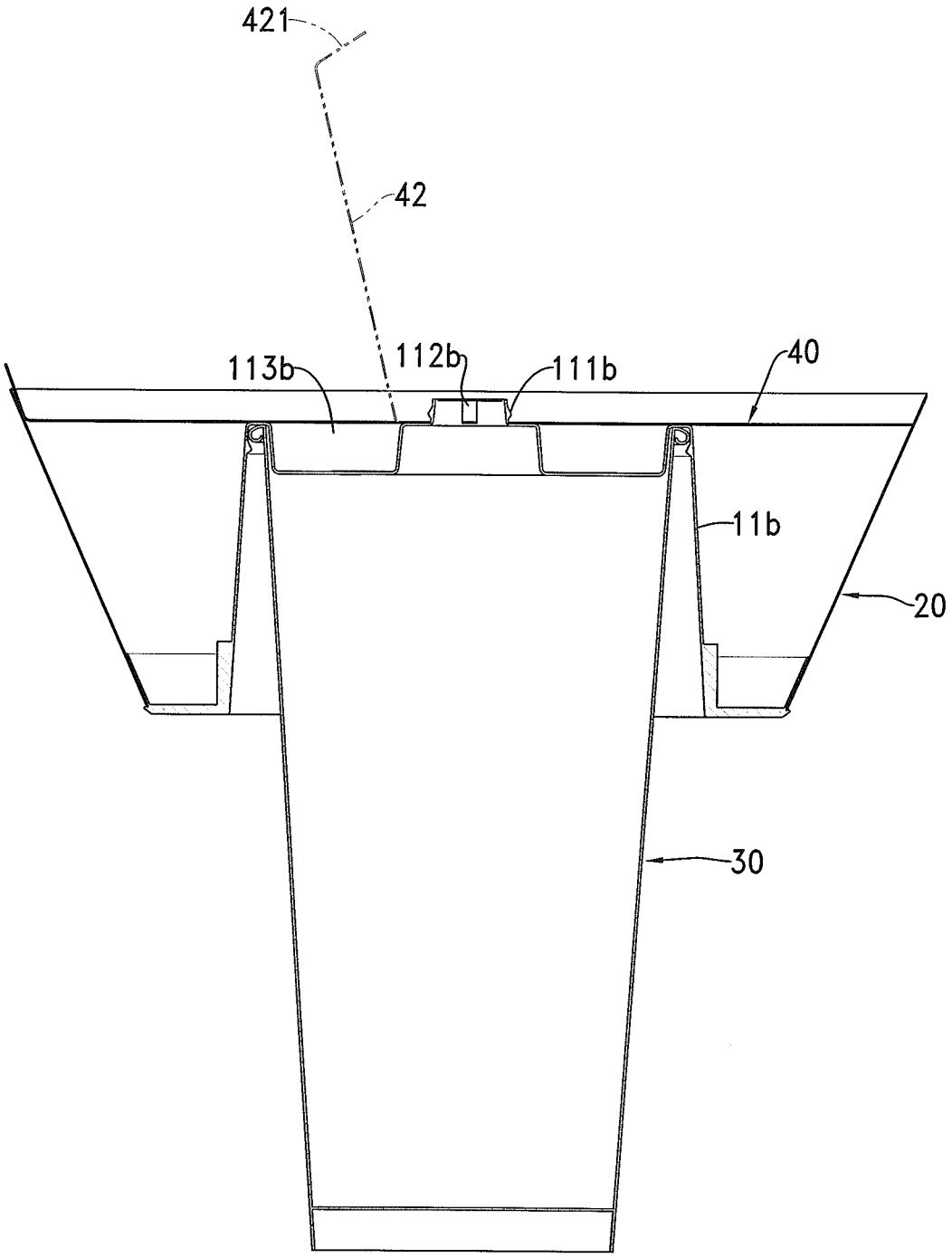
FIG. 16 is a cross-sectional side view of the cover combined with the lifting board in FIG. 15.

With reference to FIGS. 15 to 16, a third embodiment of a dual-use lid in accordance with the present invention comprises a cover 10*b* and a lifting board 40. The cover 10*b* is connected to the annulus 20 and the container 30 and has a protruding segment 11*b*. The protruding segment 11*b* is formed on a top surface of the cover 10*b* and has a fastening portion 111*b*, an inserting opening 112*b*, and multiple recesses 113*b*. The fastening portion 111*b* centrally extends on a top surface of the protruding segment 11*b*. The inserting opening 112*b* is formed through the fastening portion 111*b* of the protruding segment 11*b*. The recesses 113*b* are formed on the top surface of the protruding segment 11*b* and around the fastening portion 111*b*.

The lifting board 40 is mounted in the annulus 20, is connected to the cover 10*b*, and has an engaging part 41 and a flipping part 42. The engaging part 41 has a through hole 411, and the through hole 411 is formed through the engaging part 41 near a straight edge of the engaging part 41. The through hole 411 is disposed securely around the fastening portion 111*b*. The flipping part 42 is movably connected to the straight edge of the engaging part 41 and has a flipping sheet 421. The flipping sheet 421 is formed on a curved edge of the flipping part 42.

Figure 17:
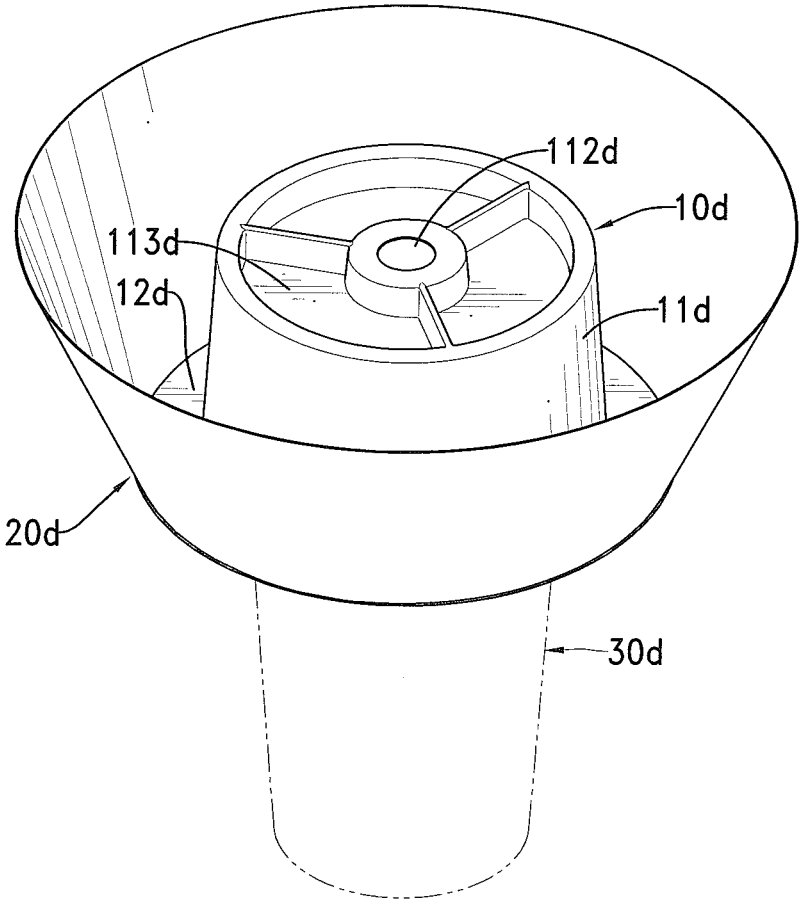
FIG. 17 is a perspective view of a fourth embodiment of a dual-use lid in accordance with the present invention.
Figure 18:
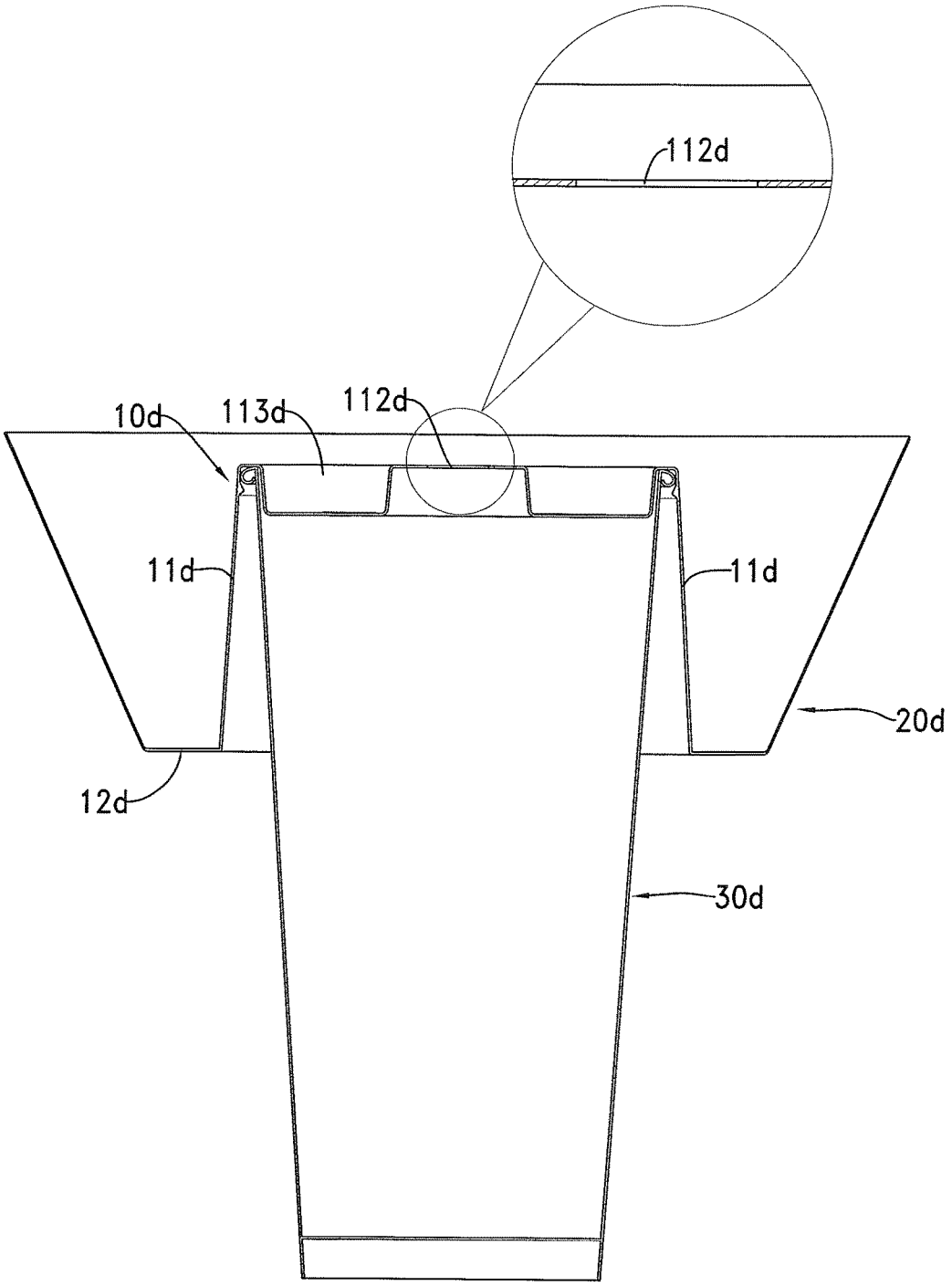
FIG. 18 is a cross-sectional side view of the containing assembly in FIG. 17.

With reference to FIGS. 17 to 18, a fourth embodiment of a dual-use lid in accordance with the present invention comprises a cover 10*d* and an annulus 20*d*. The cover 10*d* has a protruding segment 11*d* and an annular board 12*d*. The protruding segment 11*d* is formed on a top surface of the cover 10*d* and has an inserting opening 112*d* and multiple recesses 113*d*. The inserting opening 112*d* is formed through the protruding segment 11*b*. The recesses 113*d* are formed on the top surface of the protruding segment 11*d* and around the inserting opening 112*d*. The annulus 20*d* is integrally formed on the annular board 12*d* of the cover 10*d*. The container 30*d* is detachably mounted in the protruding segment 11*d* of the cover 10*d*.

The present invention has the following advantages:

1. The annulus 20, 20*c* is detachably mounted on the cover 10, 10*b*, and the container 30 is detachably combined with the cover 10, 10*b*, as well. Thus users can directly remove the used annulus 20, 20*c* for replacement with a new annulus 20, 20*c*, and this can prevent mixing of tastes of different foods.

2. The cover 10, 10*b*, is used to combine with different types of containers 30 and the annulus 20, 20*c* is mounted on the cover 10, 10*b*, to form a space. Therefore, the food could be put in the space between the annulus 20, 20*c* and the cover 10, 10*b*, and users are able to have drink and food at the same time. Furthermore, the cover 10, 10*b*, is removable so that the containing assembly can be transported and stored in larger amount than the conventional container.

3. The annuluses 20, 20*c* can be piled when the first combining portions 22 and the second combining portions 23 are unfolded. The storage space for the annuluses 20, 20*c* could be reduced.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A dual-use lid comprising:

a cover having:

a protruding segment formed on a top surface of the cover; with the protruding segment having:

a groove formed on a bottom side of the protruding segment;

a first circular groove formed on an inner surface of the protruding segment and having a first ring formed on a bottom edge of the first circular groove;

a second circular groove formed on the inner surface of the protruding segment under the first circular groove, with the second circular groove having a second ring formed on a bottom edge of the second circular groove;

a third circular groove formed on the inner surface of the protruding segment over the first circular groove, with the third circular groove having a third ring formed on a bottom edge of the third circular groove;

a combining groove formed on the inner surface of the protruding segment over the third circular groove, with the combining groove having a fourth ring formed on a bottom edge of the combining groove; and an inserting opening formed through the protruding segment; and an annular board extending outward from a bottom edge of the protruding segment; and an annulus mounted on the annular board of the cover.

2. The dual-use lid as claimed in claim 1, wherein the cover has:

an annular wall extending upward from an outer edge of the annular board on the cover; and a circular body formed on a bottom edge of the annular wall, wherein a bottom diameter of the annular wall is smaller than a diameter of the circular body.

3. The dual-use lid as claimed in claim 2, wherein the circular body has a circular portion, wherein the circular portion is L-shaped in cross section, and wherein the circular portion has:

an inner circular sheet formed on an inner side of the circular portion;

an outer circular sheet formed on an outer side of the circular portion, a height of the inner circular sheet being larger than a height of the outer circular sheet; and a circular slot formed between the inner circular sheet and the outer circular sheet.

* * * * *